US007937809B2

(12) United States Patent
Tuller

(10) Patent No.: US 7,937,809 B2
(45) Date of Patent: May 10, 2011

(54) DYNAMIC WINDOW JAMB CHANNEL BLOCK

(75) Inventor: Jeffrey Tuller, Rochester, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 43 days.

(21) Appl. No.: 12/116,734

(22) Filed: May 7, 2008

(65) Prior Publication Data

US 2009/0277097 A1 Nov. 12, 2009

(51) Int. Cl.
*E05D 13/00* (2006.01)

(52) U.S. Cl. ..... 16/193

(58) Field of Classification Search ..... 16/193; 49/445, 447

See application file for complete search history.

(56) References Cited

U.S. PATENT DOCUMENTS

| | | | | | |
|---|---|---|---|---|---|
| 2,792,597 | A * | 5/1957 | Prosser | 49/429 |
| 3,498,000 | A * | 3/1970 | Nobes | 49/446 |
| 3,524,282 | A * | 8/1970 | Kraft et al. | 49/181 |
| 5,014,466 | A | 5/1991 | Winner | |
| D317,713 | S * | 6/1991 | Kaplan | D8/402 |
| 5,353,548 | A | 10/1994 | Westfall | |
| 5,365,638 | A * | 11/1994 | Braid et al. | 16/197 |
| 5,463,793 | A | 11/1995 | Westfall | |
| 5,544,450 | A * | 8/1996 | Schmidt et al. | 49/419 |
| 6,606,761 | B2 * | 8/2003 | Braid et al. | 16/197 |
| 6,763,550 | B2 * | 7/2004 | Regnier | 16/193 |
| 2008/0047099 | A1 * | 2/2008 | Malek | 16/197 |

FOREIGN PATENT DOCUMENTS

CA 2119506 2/1997

* cited by examiner

*Primary Examiner* — David J Bagnell
*Assistant Examiner* — Matthew Sullivan
(74) *Attorney, Agent, or Firm* — Harness, Dickey & Pierce, P.L.C.

(57) ABSTRACT

The device of the present invention is identified as a chimney block for use in the jamb channels of window frames. The chimney block impedes or substantially reduces the vertical movement of air through the jamb channel. The reduction in air movement improves the insulating properties of the window and minimizes the amount of dust and fine dirt that might otherwise enter the jamb channel resulting in a progressively increasing force required to move the sash through the jamb channel. It consists of a vertical structural element which is secured to a planar sealing element that conforms to the cross section of the jamb channel. Legs or struts are attached in proximity to the other end of the vertical structural element to insure that the chimney block essentially remains in the same position to provide an air block.

16 Claims, 5 Drawing Sheets

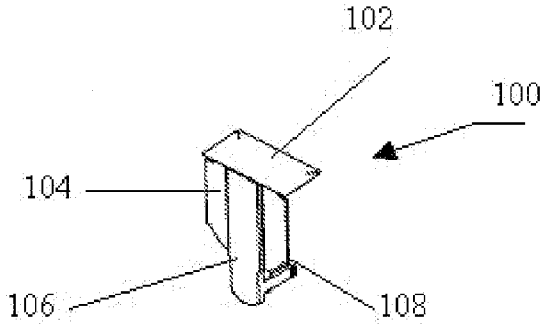
Fig. 1A
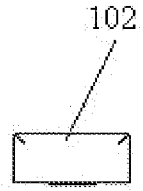
Fig. 1B
Fig. 1C
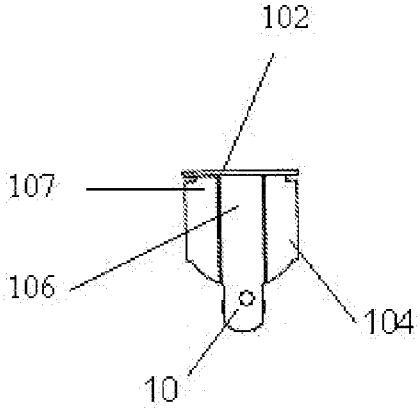
Fig. 1D
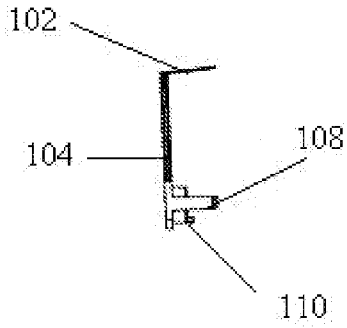

DYNAMIC WINDOW JAMB CHANNEL BLOCK

FIELD OF THE INVENTION

The invention pertains to the field of window frames. More particularly, the invention pertains to a moveable device that travels up and down the jamb channel of the window frame with the movement of the sash to impede the transfer of air and debris into and through the jamb channel.

BACKGROUND OF THE INVENTION

Window frames may consist of either a single sash or two sashes, and are referred to, respectively, as single or double hung windows. A window assembly generally includes a window frame, at least one sash, a pair of opposing window jambs, each jamb having a channel for allowing the vertical travel of each sash, and usually a balance to assist with the raising and lowering of the sash to which it is attached by providing a counterbalance force to the weight of the sash.

The jambs are vertically positioned on either side of the sash within the window frame assembly. Because they must provide a space to permit the sash shoe or carrier to freely traverse up and down, and the jamb channels are not well sealed at either their top or bottom. The vertically positioned channel forms, in effect, a "chimney" that permits air to easily flow upwardly compromising the insulating value of the window. Further, dust or other fine particles can enter the jamb channel, which can ultimately gum up the carrier or at least increase the force necessary to move the carrier through the channel.

In a conventional curl spring carrier, such as is disclosed in U.S. Pat. Nos. 5,353,548 and 5,463,793, the end of the spring is attached to the wall of the jamb channel via a fastener, most commonly a screw. As the sash is manually moved to either open or close the window, the curl spring, which may be coiled up within the carrier, will either uncoil as the carrier is moved away from the point of attachment or it will retract and recoil itself within the carrier as the carrier is moved toward the point of attachment. The opening of a window will depend on the position of the sash. An upper sash will open by being moved downwardly in the jamb channel and the lower sash will be moved upwardly along the jamb channel. The points of attachment and whether the curl spring is coiled within the carrier or is uncoiled in the sash's "closed" position may vary from window design to window design.

Windows are subjected to manufacturing standards that mandate specific air flow through standards for each design. For example, there are a number of different standards which apply depending upon which region of the country the window is scheduled to be installed. A blower is sealably attached to the window by a common duct, usually by cutting a hole into the glass or plexiglass pane of one of the sashes. Pressurized air is then blown through the duct and any leaks are sought out and recorded. The minimum standard which all windows must pass is 25 miles per hour (mph). Higher pressures must be withstood by windows being installed in different parts of the country. For example, a DP (Design Pressure) of 35 is required for non-coastal applications. DP 35 is the equivalent of approximately 143 mph. DP55 is the preferred rating for coastal applications, due to higher wind pressures. DP 55 approximates to 180 mph. As is quite evident, not only must the sash panes be able to structurally withstand this high pressure, but the various moving and interacting elements of each window frame must be built to such tolerances so as to withstand or at least minimize the effects of these wind pressure standards.

Numerous attempts have been made to try to meet these aggressive standards; however they have all met with only limited success. For example, even if the window holds up to the pressure, the amount of air passing through the jamb channels via a "chimney effect" can be excessive. Attempts to block or alleviate these aerodynamic forces often cause unwanted side-effects, such as added excessive pressure to the movement of the sash, etc. What is necessary is an air block that substantially achieves the goal of minimizing air flow through the jamb channel, which also has the ancillary benefit of substantially reducing the amount of dirt particles that might accumulate within the channel, while still allowing the essentially unimpeded movement of the sash through the jamb channel. Further, the block cannot be so obtrusive so as to negatively affect the vertical travel of the sash through the jamb channel.

SUMMARY OF THE INVENTION

The device of the present invention is called a dynamic chimney block. It is referred to as being dynamic because it is allowed to move vertically up and down the jamb channel and not interfere with the movement of the carrier. Further, this flexibility in movement allows for greater movement of the sash, which results in a larger window opening.

The main purpose of the dynamic chimney block is to impede or substantially reduce the vertical movement of air through the jamb channel. The reduction in air movement improves the insulating properties of the window and minimizes the amount of dust and fine dirt that might otherwise enter the jamb channel which would result in a progressively increasing force required to move the sash through the jamb channel.

The dynamic chimney block has a vertical structural element to which is integrally secured on one end a planar sealing element which is configured to resemble the cross section of the jamb channel to block vertical air movement. Legs or struts are attached in proximity to the other end of the vertical structural element to insure that the dynamic chimney block remains essentially consistently positioned to provide an air block.

BRIEF DESCRIPTION OF THE DRAWING

FIGS. 1A-1D show various view angles of the dynamic window jamb channel blocking device of the invention.

DETAILED DESCRIPTION OF THE INVENTION

Figure 2:
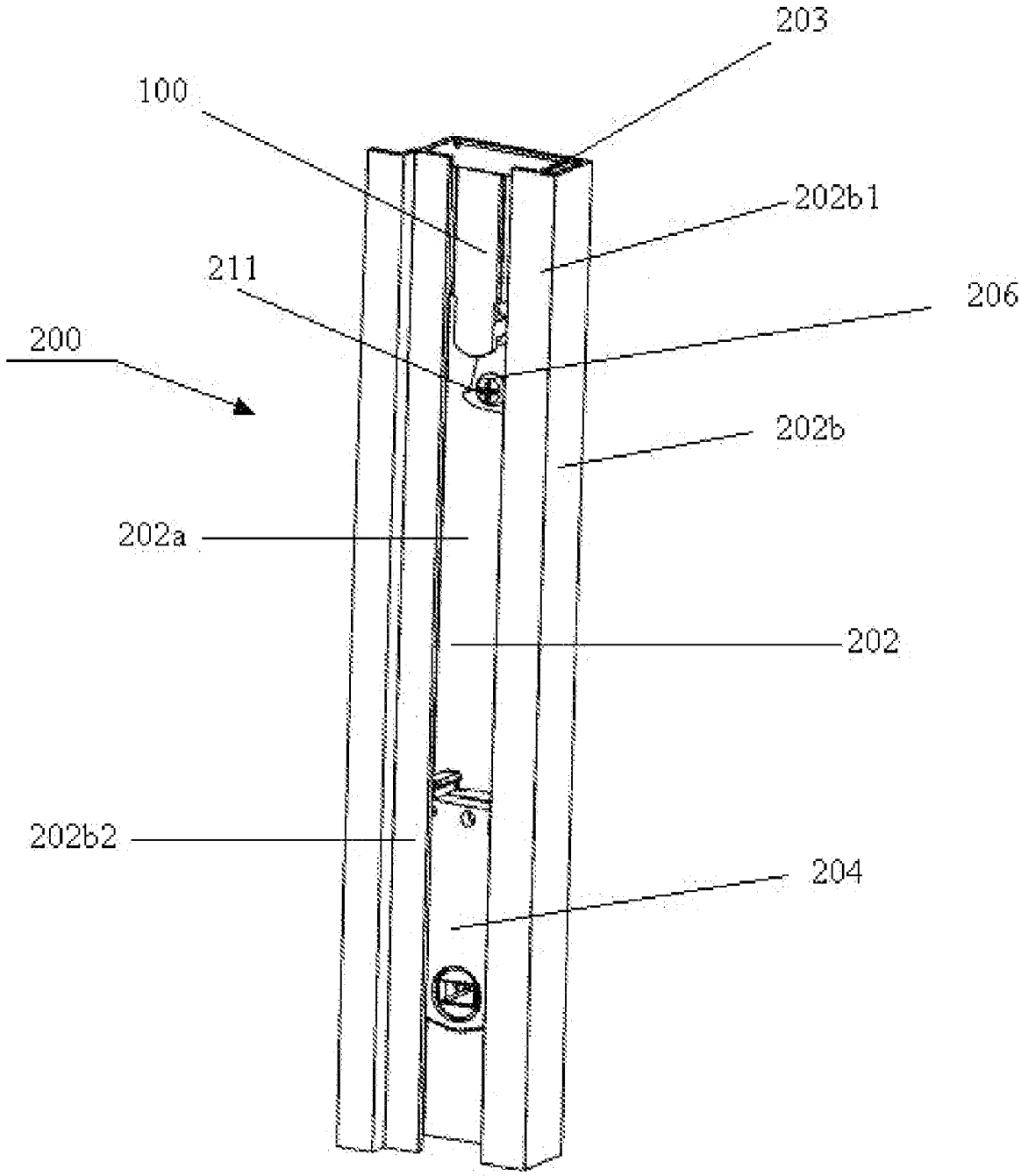
FIG. 2 shows a curl spring carrier within a jamb channel having its spring extended (not shown) along the jamb channel wall to a mounting bracket which is attached to the jamb channel wall.

Referring first to FIG. 2, what is shown is a cut away of the jamb section 200 of a window frame (not fully shown). The jamb 200 contains a channel, known as a jamb channel 202. The jamb channel 202 provides the route through which a carrier travels with the vertical movement of the sash (not shown). The presently indicated carrier is a curl spring carrier 204, which will be shown in more detail in subsequent figures.

With respect to curl spring carriers, such as 204, an elongated spring is coiled within the body of the curl spring carrier 204. The end of the spring which extends outward from the body of the carrier is secured at a specific location in the jamb channel 202 by a mounting bracket 206 (best shown in FIG. 4). With one end of the spring secured to the wall of the jamb channel 202, the curl spring carrier 204 rides up and down the jamb channel 202 with the movement of the sash.

The jamb channel 202 must be large enough to accommodate the dimensions of the carrier. The jamb channel 202 consists of a back wall 202*a*, opposing side walls 202*b*, and side wall flanges 202*b*1 and 202*b*2. However, due to the size of the jamb channel 202, there is a propensity for air to travel vertically through the channel, creating a "chimney" effect. The air usually travels "up" the jamb channel exiting at the upper end 203 of the jamb channel 202. This results in air leakage, thereby causing a loss of valuable insulating properties. Furthermore, the air can transport dust and other fine dirt particles into the jamb channel 202, which, if allowed to build up, can ultimately impede the movement of the carrier, thereby increasing the force needed to move the sash vertically up and down with respect to the window frame.

In order to solve or at least mitigate the problem described above, the novel device shown in FIGS. 1A, 1B, 1C and 1D has been discovered. What is disclosed herein is a dynamic chimney block 100. The word "dynamic" is meant to describe the fact that the dynamic chimney block 100 is able to ride vertically through the jamb channel 202 when urged by the vertical movement of the curl spring carrier 204 through the jamb channel.

The dynamic chimney block 100 consists of integrally joined segments that are designed to perform varying functions within the jamb channel 202. The dynamic chimney block 100 consists of a back brace 104 which provides the primary structural support as well as sealing between the side walls of the flanges 202*b*1 and 202*b*2. Connected to a first end of the back brace 104 is a sealing panel 102. The plane of the sealing panel 102 is slightly smaller than the cross section of the jamb channel 202 (as defined by elements 202*a*, 202*b* (x2), 202*b*1 and 202*b*2. Multiple sealing panels 202 may be used as required. This allows the dynamic chimney block 100 to provide a substantial vertical air barrier while minimizing friction that would negatively impact the movement of the sash through the jamb channel. Integrally formed in proximity to a second end of the back brace 104 and pointing in the same direction as the sealing panel 102 is at least one leg 108. Preferably, two legs 108 are present. However, this is discretionary with the designer of the specific dynamic chimney block 100. A reinforcing element 110 may optionally be used to provide additional support between the legs and the back brace 104. If required in order to improve the sealing capabilities of the dynamic chimney block 100, a raised rib 106 may be integrally joined onto the external planar surface 107 of the back brace 104. The width of the raised rib 106 cannot exceed the distance between the edges of the flanges 202*b*1 and 202*b*2. In effect, the raised rib 106 seats between the edges of flanges 202*b*1 and 202*b*2.

The dynamic chimney block 100 may consist of materials such as plastic that is substantially rigid. It must exhibit some degree of flexure so as not to fracture when it is bent around certain structures in the jamb channel. But, it must be rigid enough to retain positional integrity in the jamb channel. Various conventional plastics and/or elastomers are suitable, such as polypropylene and rigid, closed cell foams.

Figure 3:
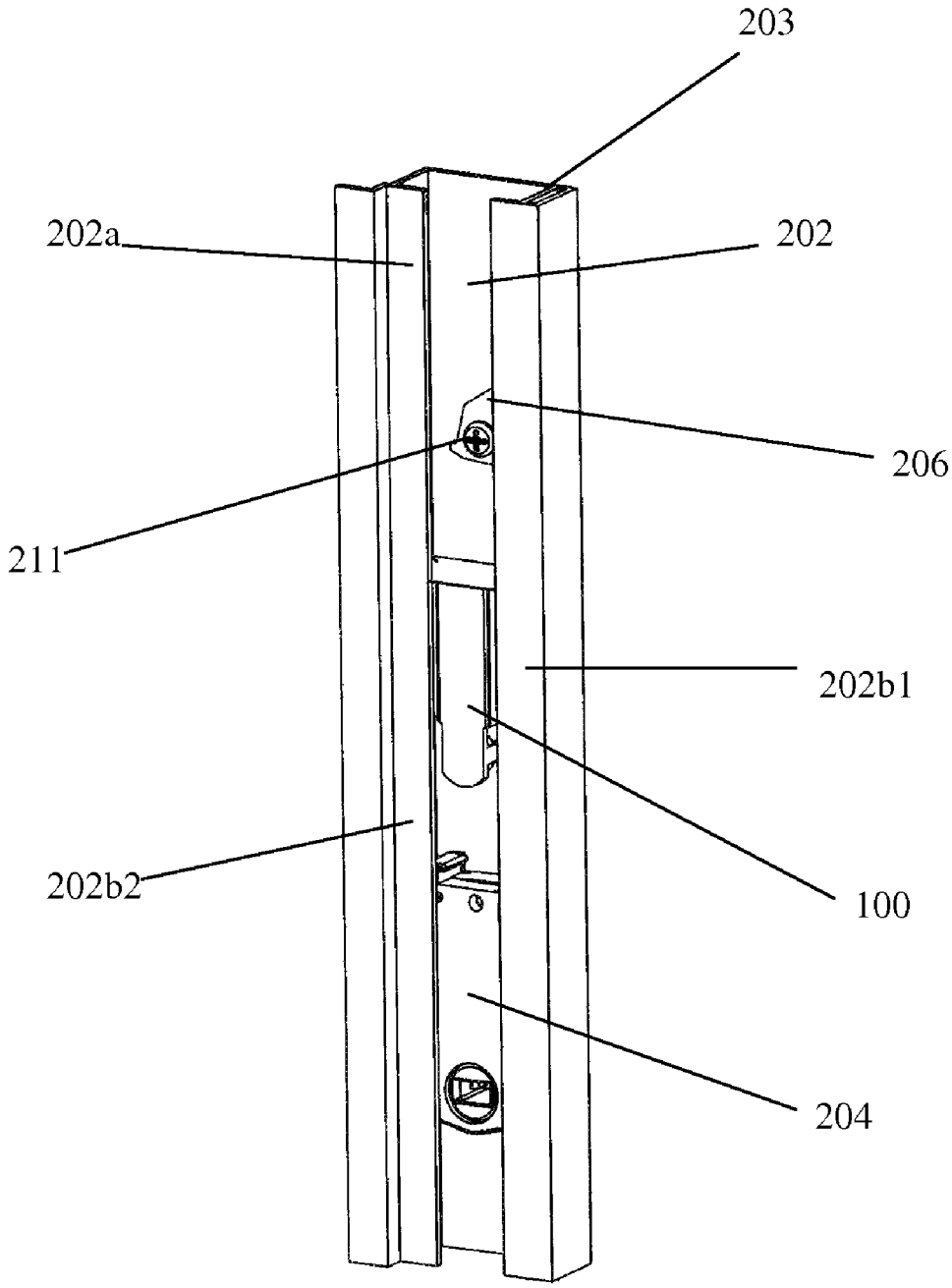
FIG. 3 shows the window blocking device having passed over the mounting bracket, being positioned between the carrier and the bracket.
Figure 4:
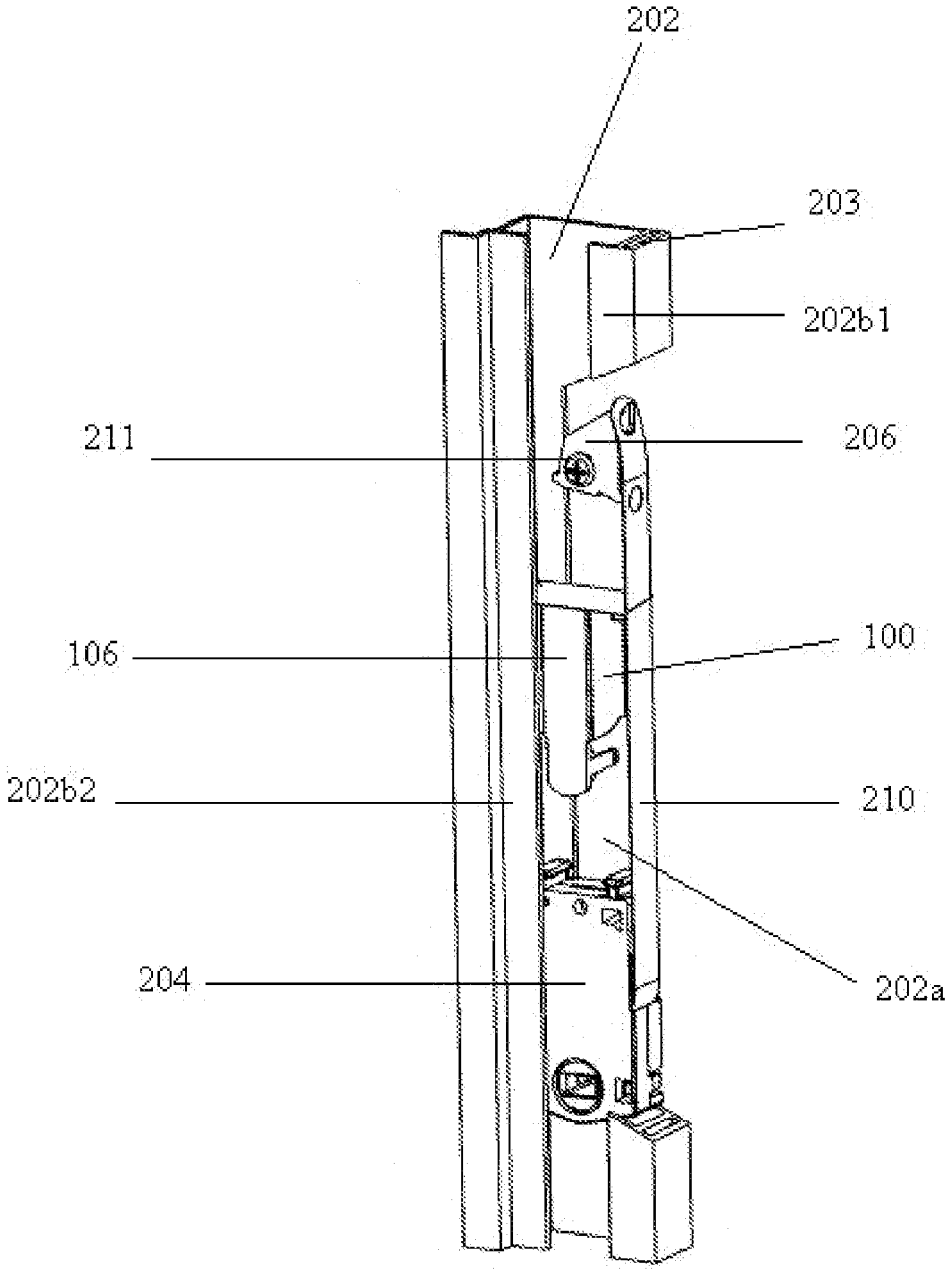
FIG. 4 shows a partial cut away view of the jamb channel showing the spring laying against a jamb channel wall extending between the curl spring carrier and the mounting bracket. The window jamb channel blocking device is positioned between the carrier and the carrier.

The method of installing the dynamic chimney block 100 into the jamb channel 202 is best described by following the progression of FIGS. 2-4. The curl spring carrier 204 is first installed into the jamb channel 202. The end of the spring 210 (FIG. 4) that is allowed to extend from the body of the carrier is secured to the back wall 202*a* of the jamb by a mounting bracket 206 which is secured by conventional means such as a rivet, screw or bolt. For illustrative purposes, the mounting means shown in the Figures is a conventional screw 211. The dynamic chimney block 100 is then inserted into jamb channel 202 in proximity to the mounting bracket 206. The legs 108 are manipulated to ride over the mounting bracket 206 and upon further urging down the jamb channel 202, the sealing panel 102 ultimately passes over the mounting bracket. The dynamic chimney block 100 is now positioned in the jamb channel 202 between the mounting bracket 206 and the curl spring carrier 204. The sash is then installed into the carriers 204 (the other jamb channel of the window frame is not shown).

Figure 5:
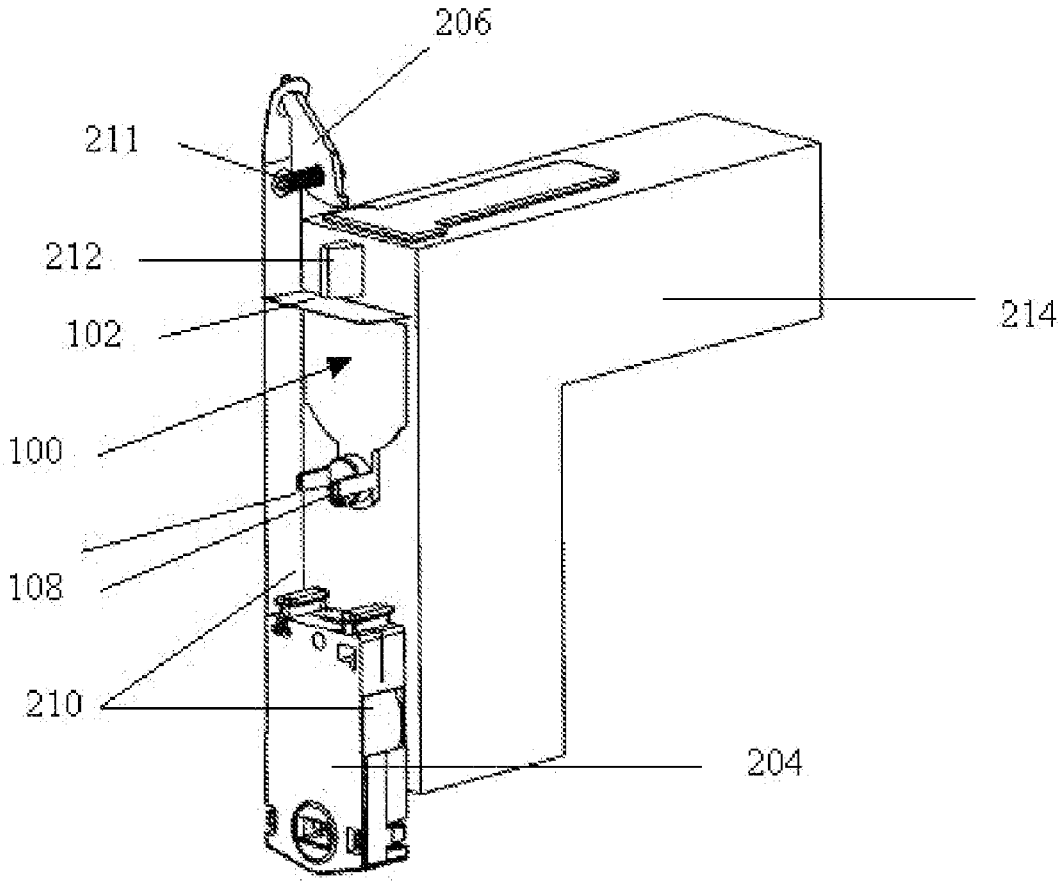
FIG. 5 shows a partial cut away view of approximating a reverse angle of FIG. 4.

With the sash now connected to the curl spring carriers 204, the sash is rotated to the vertical position and is urged downward to close the window. A tilt latch 212 (FIG. 5) locks against the side wall flanges 202*b*1, as shown in FIG. 4 (a portion of which is shown by identifier 214 in FIG. 5). At this point, the dynamic chimney block 100 is positioned immediately under the tilt latch 212. Optionally, since this is the highest vertical position that may be achieved by the dynamic chimney block 100, it may be secured to the jamb channel 202 by any number of conventional means, such as by at least one screw.

One of the key advantages of this invention is that by securing the mounting bracket higher in the jamb channel 202, the maximum vertical movement of the sash is achieved, thereby allowing for a larger window opening. As the closed window is opened by urging the sash upward, the curl spring carrier 204 will eventually contact the dynamic chimney block 100 and push the block 100 to the top of the jamb channel 202. Upon closing of the sash, the curl spring carrier 204 is moved downward and the dynamic chimney block 100 is urged just under the tilt latch 212 by the tilt latch itself.

The ability of the chimney block 100 to move ("dynamic") achieves the goals of allowing for greater vertical movement of the sash, thereby providing for a larger window opening. In addition, substantially reducing air movement improves the insulating value of the window and minimizes the amount of dust and fine dirt particles that might enter the jamb channel 202.

Even though the chimney block of the present invention is described as being "dynamic", due to its ability to move vertically along the jamb channel at the urging of the curl spring carrier 204, there may be instances where it is necessary or desirable for the manufacturer or the installer to maintain the chimney block 100 at a set position along the jamb channel. In this instance, an optional hole 10 or other suitable attachment means may be designed into the chimney block 100. In the example shown in FIG. 1C, this attachment means is indicated as being placed on the external planar surface 107 of back brace 104. In this embodiment, hole 10 would align with a complementary attachment feature on one of the jamb flanges 202*a* or 202*b*. Further, more than one attachment means may be utilized, if and as required.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A dynamic block for use in a jamb channel of a window, the jamb channel having a vertical axis, the dynamic block comprising:

a) a back brace disposed parallel with respect to the axis of the jamb channel, the back brace having a first end, a second end opposite the first end, a first major side, and a second major side opposite the first major side;

b) at least one substantially planar sealing panel integrally joined at the first end of the back brace and extending from the first major side of the back brace;

c) at least one leg disposed in proximity to the second end of the back brace and extending from the first major side of the back brace; and d) a raised rib extending from the second major side of the back brace.

2. The dynamic block of claim 1 wherein the sealing panel is in the shape of a cross section of the jamb channel, the jamb channel being formed by a back wall, two opposing side walls, and two flanges extending from the side walls toward each other, a jamb channel gap being formed between the flanges.

3. The dynamic block of claim 2 wherein the width of the raised rib substantially equals a width of the jamb channel gap.

4. The dynamic block of claim 1 wherein the at least one leg comprises two legs.

5. The dynamic block of claim 4 further comprising a leg reinforcing element between the legs and the back brace.

6. The dynamic block of claim 1 consisting of a material that is substantially rigid.

7. The dynamic block of claim 6 wherein the material is plastic.

8. The dynamic block of claim 1 wherein the sealing panel is sized such that the dynamic block substantially prevents flow of air through the jamb channel and minimizes entry of dust and dirt particles into the jamb channel.

9. A method for installing a dynamic block into a jamb channel of a window, the dynamic block comprising a back brace disposed parallel with respect to a vertical axis of the jamb channel, the back brace having a first end, a second end opposite the first end, a first major side, and a second major side opposite the first major side, at least one substantially planar sealing panel integrally joined at the first end of the back brace and extending from the first major side of the back brace, at least one leg disposed in proximity to the second end of the back brace and extending from the first major side of the back brace, the jamb channel having an upper end and a lower end and being formed by a back wall and two opposing side walls, the method comprising the steps of:

a) inserting a curl spring carrier into the jamb channel, the curl spring carrier having an open end for permitting the travel of a first end of the spring, and securing the first end of the spring with a mounting bracket into the back wall of the jamb channel in proximity to the upper end of the jamb channel;

b) connecting the sash to the curl spring carrier;

c) inserting the dynamic block into the upper end of the jamb channel with the legs of the dynamic block being inserted first;

d) urging first the legs and then the sealing panel over the mounting bracket; and e) rotating the sash to a vertical position and urging the sash downward in the jamb channel until a tilt latch in the sash secures into a mating element on the back wall of the jamb channel in proximity to the upper end of the jamb channel.

10. A window jamb channel block in a jamb channel of a window jamb, the jamb channel having a vertical axis being formed by a back wall, two opposing side walls, and two flanges extending from the side walls toward each other, a jamb channel gap being formed between the flanges, the window jamb channel block comprising:

a) a back brace disposed along the side of the jamb channel formed by the flanges, the back brace having a first end, a second end opposite the first end, a first major side, and a second major side opposite the first major side;

b) at least one substantially planar sealing panel integrally joined at the top end of the back brace and extending from the first major side of the back brace; and c) at least one leg disposed in proximity to the bottom end of the back brace and extending from the first major side of the back brace toward the back wall.

11. The window jamb channel block of claim 10 wherein the sealing panel has a shape in the shape of a cross section of the jamb channel.

12. The window jamb channel block of claim 10 further comprising a raised rib along an exterior surface of the back brace extending into the jamb channel gap.

13. The window jamb channel block of claim 12 wherein a width of the raised rib substantially equals a width of the jamb channel gap.

14. The window jamb channel block of claim 10 wherein the sealing panel is sized such that the window jamb channel block substantially prevents flow of air through the jamb channel and minimizes entry of dust and dirt particles into the jamb channel.

15. The window jamb channel block of claim 10 wherein the sealing panel is formed such that a tilt latch on a window sash urges the window jamb channel block downward in the jamb channel by contacting the substantially planar sealing panel when the window sash is lowered.

16. The window jamb channel block of claim 10 wherein the leg is formed such that a carrier of a window balance mounted in the jamb channel urges the window jamb channel block upward in the jamb channel by contacting the leg when a window sash attached to the carrier is raised.

* * * * *